US007073625B2

(12) United States Patent
Barth

(10) Patent No.: US 7,073,625 B2
(45) Date of Patent: Jul. 11, 2006

(54) EXHAUST GAS MUFFLER AND FLOW DIRECTOR

(76) Inventor: Randolph S. Barth, 55 Moreau Ave., Freehold, NJ (US) 07728

( * ) Notice: Subject to any disclaimer, the term of this patent is extended or adjusted under 35 U.S.C. 154(b) by 304 days.

(21) Appl. No.: 10/666,329

(22) Filed: Sep. 22, 2003

(65) Prior Publication Data

US 2005/0061579 A1 Mar. 24, 2005

(51) Int. Cl.
*F01N 7/10* (2006.01)
*F01N 1/10* (2006.01)
*F01N 1/24* (2006.01)

(52) U.S. Cl. ..... 181/240; 180/252; 180/256; 180/257; 60/323

(58) Field of Classification Search ..... 181/240, 181/252, 256, 251, 257, 238; 123/184.57; 60/322, 323
See application file for complete search history.

(56) References Cited

U.S. PATENT DOCUMENTS

| | | | | | |
|---|---|---|---|---|---|
| 1,947,987 | A * | 2/1934 | Hathorn | 181/240 |
| 2,929,462 | A * | 3/1960 | Nowak | 181/252 |
| 3,786,791 | A * | 1/1974 | Richardson | 123/65 EM |
| 3,977,493 | A * | 8/1976 | Richardson | 181/253 |
| 4,234,054 | A * | 11/1980 | Chapin | 181/252 |
| 4,236,597 | A * | 12/1980 | Kiss et al. | 181/224 |
| 4,356,885 | A * | 11/1982 | Dello | 181/227 |
| 4,404,992 | A * | 9/1983 | Sasaki et al. | 138/140 |
| 4,410,013 | A * | 10/1983 | Sasaki et al. | 138/149 |
| 4,529,060 | A * | 7/1985 | Komauer et al. | 181/227 |
| 4,596,306 | A * | 6/1986 | Abe et al. | 181/228 |
| 5,092,122 | A * | 3/1992 | Bainbridge | 60/272 |
| 5,144,799 | A * | 9/1992 | Barth | 60/313 |
| 5,199,258 | A * | 4/1993 | Barth | 60/313 |
| 5,253,680 | A * | 10/1993 | Matsumoto | 138/148 |
| 5,351,481 | A * | 10/1994 | Flugger | 60/273 |
| 5,351,483 | A * | 10/1994 | Riley et al. | 60/274 |
| 5,419,127 | A * | 5/1995 | Moore, III | 60/322 |
| 5,579,639 | A * | 12/1996 | Shimoji et al. | 60/322 |
| 5,633,482 | A * | 5/1997 | Erion et al. | 181/282 |
| 5,881,554 | A * | 3/1999 | Novak et al. | 60/302 |
| 6,082,104 | A * | 7/2000 | Hyakutake et al. | 60/323 |
| 6,209,319 | B1 * | 4/2001 | Maeda et al. | 60/323 |
| 6,382,348 | B1 * | 5/2002 | Chen | 181/239 |
| 6,585,078 | B1 * | 7/2003 | Curtice et al. | 181/252 |
| 6,702,062 | B1 * | 3/2004 | Kusabiraki et al. | 181/240 |
| 2002/0166720 | A1 * | 11/2002 | Kusabiraki et al. | 181/240 |
| 2004/0050039 | A1 * | 3/2004 | Matsuda | 60/323 |

* cited by examiner

*Primary Examiner*—Edgardo San Martin
(74) *Attorney, Agent, or Firm*—Charles I. Brodsky

(57) ABSTRACT

Either or both of an exhaust pipe coupled to the output end of an automobile engine collector pipe or the plurality of pipes coupled to the input apertures of the collector pipe from the engine are apertured along their lengths and contained within a further surrounding pipe in providing an exhaust which simultaneously serves as a muffler for the vehicle and to traverse the various component parts of its exhaust system and/or the vehicle engine when composed of a plurality of pipe segments, individual ones of which are of preselected length, and cut at their respective ends at preselected angles for joining together in appropriate orientation.

7 Claims, 6 Drawing Sheets

EXHAUST GAS MUFFLER AND FLOW DIRECTOR

STATEMENT REGARDING FEDERALLY SPONSORED RESEARCH OR DEVELOPMENT

Research and development of this invention and Application have not been federally sponsored, and no rights are given under any Federal program.

CROSS-REFERENCE TO RELATED APPLICATIONS

NONE

REFERENCE TO A MICROFICHE APPENDIX

NOT APPLICABLE

BACKGROUND OF THE INVENTION

1. Field of the Invention

This invention relates to internal combustion automotive vehicles, in general, and to an exhaust system which improves fuel economy, torque, and horsepower while reducing back-pressure, in particular.

2. Description of the Related Art

As is well known and understood, individual pipes are connected to the cylinder head exhausts of an internal combustion automotive engine, and coupled to the apertures of a collector pipe which in turn is coupled to the vehicle's exhaust system. As set out in my U.S. Pat. No. 5,199,258 ("Adjustable Torque/Horsepower Exhaust Control System"), header systems are available and individually tailored to a particular make and model of the vehicle to improve operating performance—but suffer the disadvantage that a header system designed for one vehicle is not interchangeable with another. As described, this follows because of the different spacings and locations of systems in the engine compartment and undercarriage of the vehicle, so that different physical and mechanical specifications have to be satisfied for each individual installation. While system performance can be improved by these header designs, their actual installation into the motor vehicle has proven quite cumbersome. In many installations, for example, the bendings in the header pipes appear to come unreasonable close to power systems for ease of installation—and, in many instances, led to a need to actually hoist the engine in order to properly place the header into position.

As also set out in my U.S. Pat. No. 5,144,799 ("Crossfire Calibrated Exhaust System"), the exhaust pipe which leaves the muffler in typical automotive engine constructions is most oftentimes bent in various odd-shapes so as to clear the rear housing of the automotive vehicle, the power steering systems, and other control installations, in joining up with the tailpipe to channel the exhaust flow away. Experimentation showed that these bends added such length of piping to the exhaust system as to frequently "load-up" the engine, making it difficult to breath, causing an uneven performance, choking the engine.

As both my patents describe, overall performance is enhanced by cutting the pipes into individual sections to clear obstructions, rather than being bent into position. Experimentation showed that this shortened the path, for example, that the exhaust gases had to take in being channeled to the outside atmosphere, and lessened any propensity for the engine "loading-up". By selecting various diameters, lengths, and the angles at which the pipes were cut, not only were the manners of installation simplified, but a degree of calibration became available to control torque, horsepower, manifold vacuum, exhaust flow and engine temperatures associated with the various systems when in use. One of the problems which persisted, however, dealt with the "back-pressure" associated with the muffler employed, and with its overall effect on the exhibited fuel economy.

SUMMARY OF THE INVENTION

As will be seen below, the piping combination of the present invention simultaneously eliminates the conventional muffler employed in a vehicle exhaust system as a separate component, while directing the vehicle's exhaust gas flow in a manner which itself provides a "muffling" effect. As will be described, individual pipe segments are cut and angled both in the header system and in the exhaust system of the vehicle, and arranged to seat within surrounding pipes which are themselves cut and angled in individual segments in containing either or both of the exhaust pipe segments and all of the header pipe segments. With both of the exhaust pipe segments and all of the header pipe segments being thus surrounded, optimum performance results from a further provision of including apertures along the lateral lengths of the inside pipe segments, with a steel wool-type wrapping around those apertures within the enclosed space. With the contained pipe segments being centered within the overlying surrounding pipe segments, then, the optimum performance follows—although enhanced results follow with just the exhaust pipe segments being surrounded, with or without the steel wool-type wrapping—or with just each of the header pipe segments being enclosed, with or without its own further wrapping. Essentially an exhaust system of "pipe segments within pipe segments" results, which serves in directing the exhaust gas flow and in reducing the "back-pressures" associated with conventional muffler component systems which typify the prior art. As with the individual pipe segments for the exhaust pipe and for the header pipes, the individual pipe segments of the further surrounding pipes of the invention could be secured by welding, for example.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
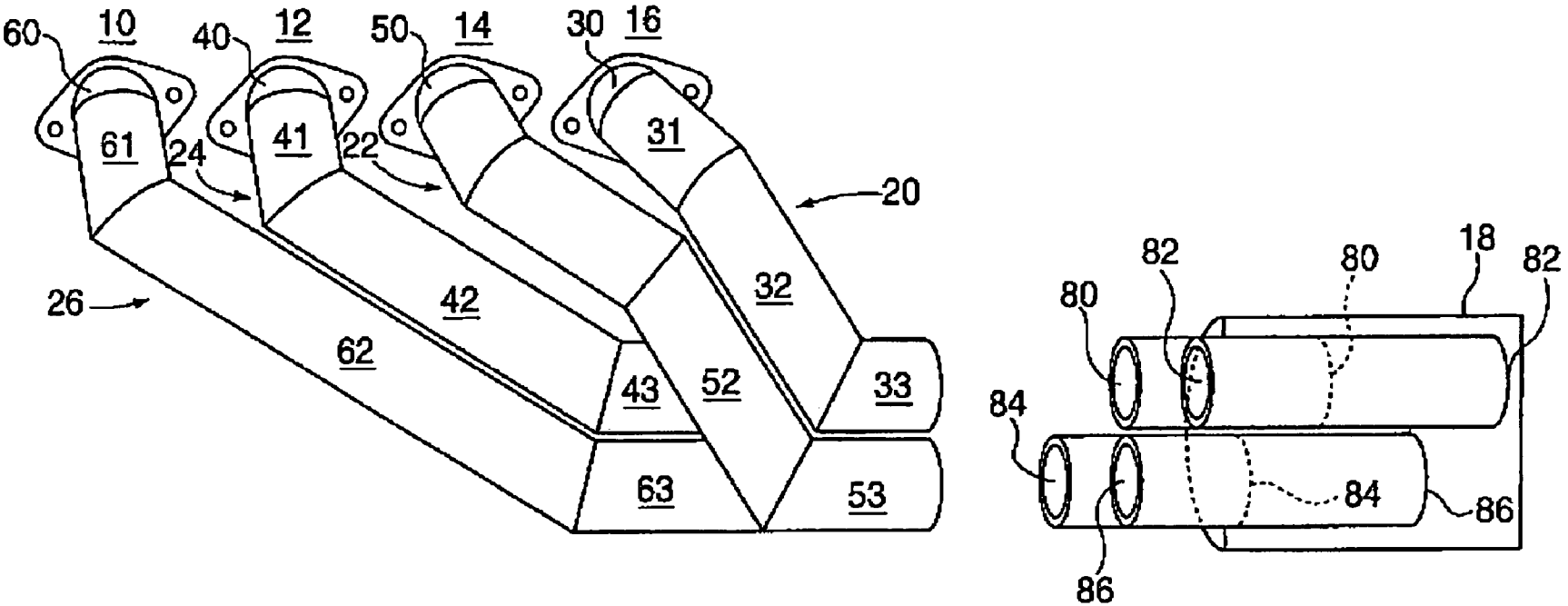
FIG. 1 Prior Art
FIG. 1 pictorially illustrates the four header pipes that typically come off one side of a V-8 automotive internal combustion engine by coupling to the exhaust cylinder heads.

In FIG. 1, the engine cylinder heads on one side of a V-8 engine are represented by the notations 10, 12, 14 and 16. The collector into which the individual header pipes will couple is shown at 18, with the four individual header pipes being generally shown as 20, 22, 24 and 26. As will be appreciated, because of the other components and systems present in the engine compartment of the vehicle, the header pipes—tailored for a particular vehicle manufacture, model and year—are not all the same length, and not all cut the same way, but are selected of a length, cut and angle so as to provide the needed bend and clearance in eventually coupling with the collector 18. Thus, and for purposes of illustration, the header pipe 20 is shown as comprising four pipe segments 30, 31, 32, 33 with the segment 33 physically being in front of a portion of the segment 43, which together with the segments 40–42 make up the header pipe 24. As will be obvious from FIG. 1, the overall length of the pipe segments 30–33 of header pipe 20 is less than the overall length of the pipe segments 40–43 of the header pipe 24.

Also shown in FIG. 1 is a typical third header pipe 22, comprised of four pipe segments 50, 51, 52 and 53, with the pipe segment 53 being physically placed in front of a portion of the pipe segment 63 of the header pipe 26, having three other pipe segments at 60, 61 and 62. As will be apparent, the overall length of segments 50–53 of header pipe 22 will be seen to be less than the overall length of the pipe segments 60–63 of the header pipe 26. As will also be appreciated from this illustration, the overall length of the header pipe 26 is greater than the overall length of the header pipe 24—which, in turn, is greater than the overall length of the header pipe 22, and with the header pipe 20 being of the shortest overall length of the four pipes. In a typical construction, the outside diameters are all selected substantially equal, and in the order of 2".

Figure 2:
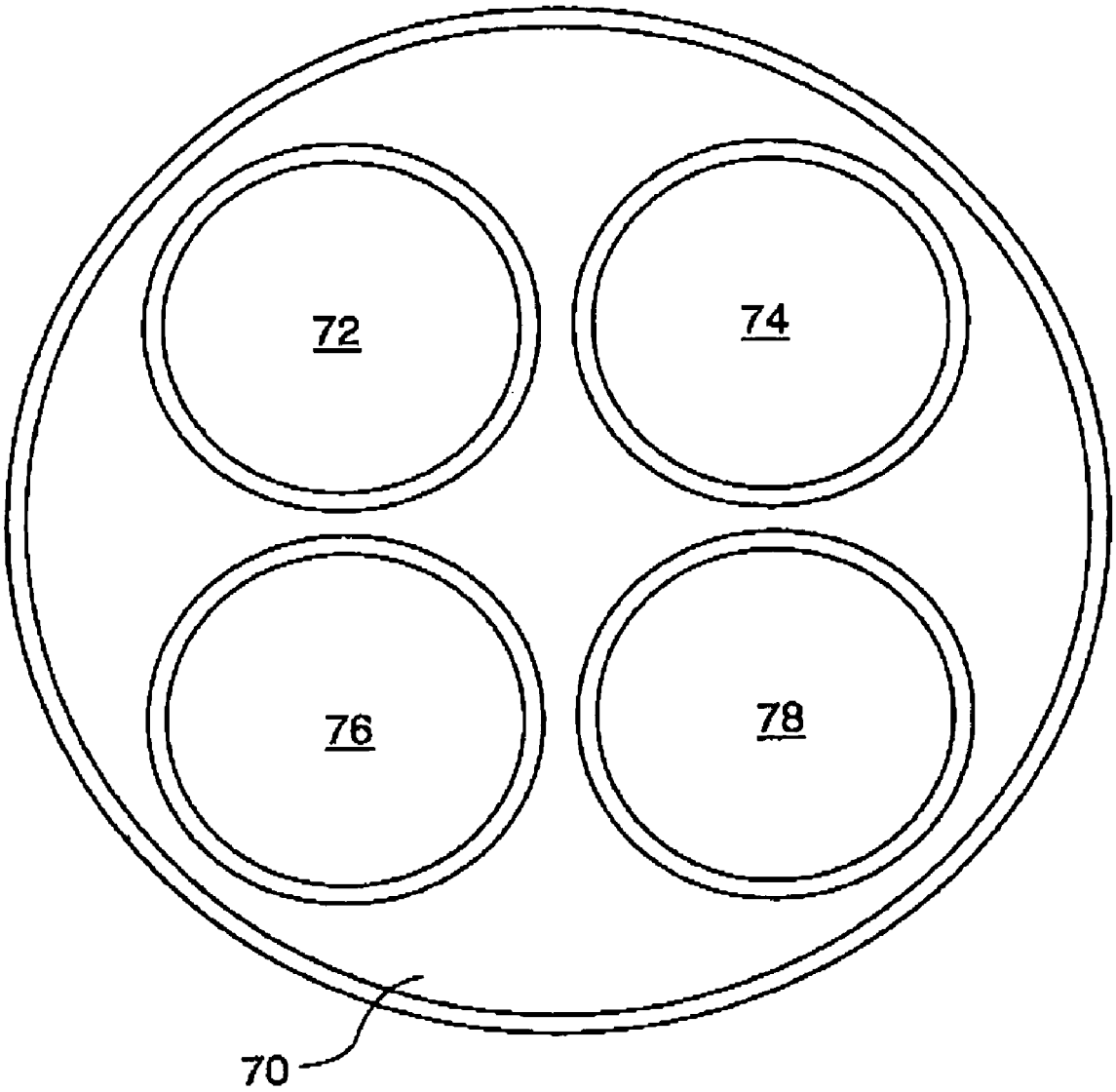
FIG. 2 Prior Art
FIG. 2 is a front view of a collector constructed in accordance with the teachings of the invention described in my U.S. Pat. No. 5,199,258.

Referring now to FIG. 2, the front view of the collector 18 there shown illustrates the collector as having a plate 70 internally secured to the collector, as by an appropriate welding, along with four apertures or ports 72, 74, 76 and 78. As is also shown—and as will be more clearly understood from the following FIG. 3—, secured to each of the apertures 72, 74, 76 and 78 are four, smaller collector pipes 80, 82, 84, 86, each of which has an inner diameter slightly greater than the outer diameter of the header pipes 20, 22, 24, 26—which, for header pipes of 2" outer diameter might be 2⅛" inner diameter for each collector pipe.

As will be apparent, and because of this difference in respective diameters, the header pipes 20, 22, 24 and 26 are each able to slide within the collector pipes 80, 82, 84 and 86, in easing their respective insertions and in facilitating their respective removals, one from another. Thus, when imagining the rotation of the collector 18 inwardly of the plane of the paper and to the right of the position shown in FIG. 2, one arrives at the orientation shown in FIG. 3, wherein the header pipe 24 would be oriented to slide within the upper-left aperture 72 (where collector pipe 80 is secured), while the header pipe 20 would be oriented to slide within the upper right aperture 74 (where collector pipe 82 is secured). In like manner, and with this rotation and orientation, the header pipe 26 would be oriented to slide within the lower-left aperture 76 (where collector pipe 84 is secured), and header pipe 22 would be oriented to slide within the lower-right aperture 78 (where collector pipe 86 is secured). As will be appreciated, because of the clearance of the header pipes with the collector pipes where they are coupled together, it becomes then but a simple matter to slidably remove the header pipe from its respective collector input pipe, and to then adjust the header pipe out-of-the-way when it is desired to service the various components, systems and/or assemblies of the vehicle previously obstructed from access by the header pipes in prior art configurations.

Figure 3:
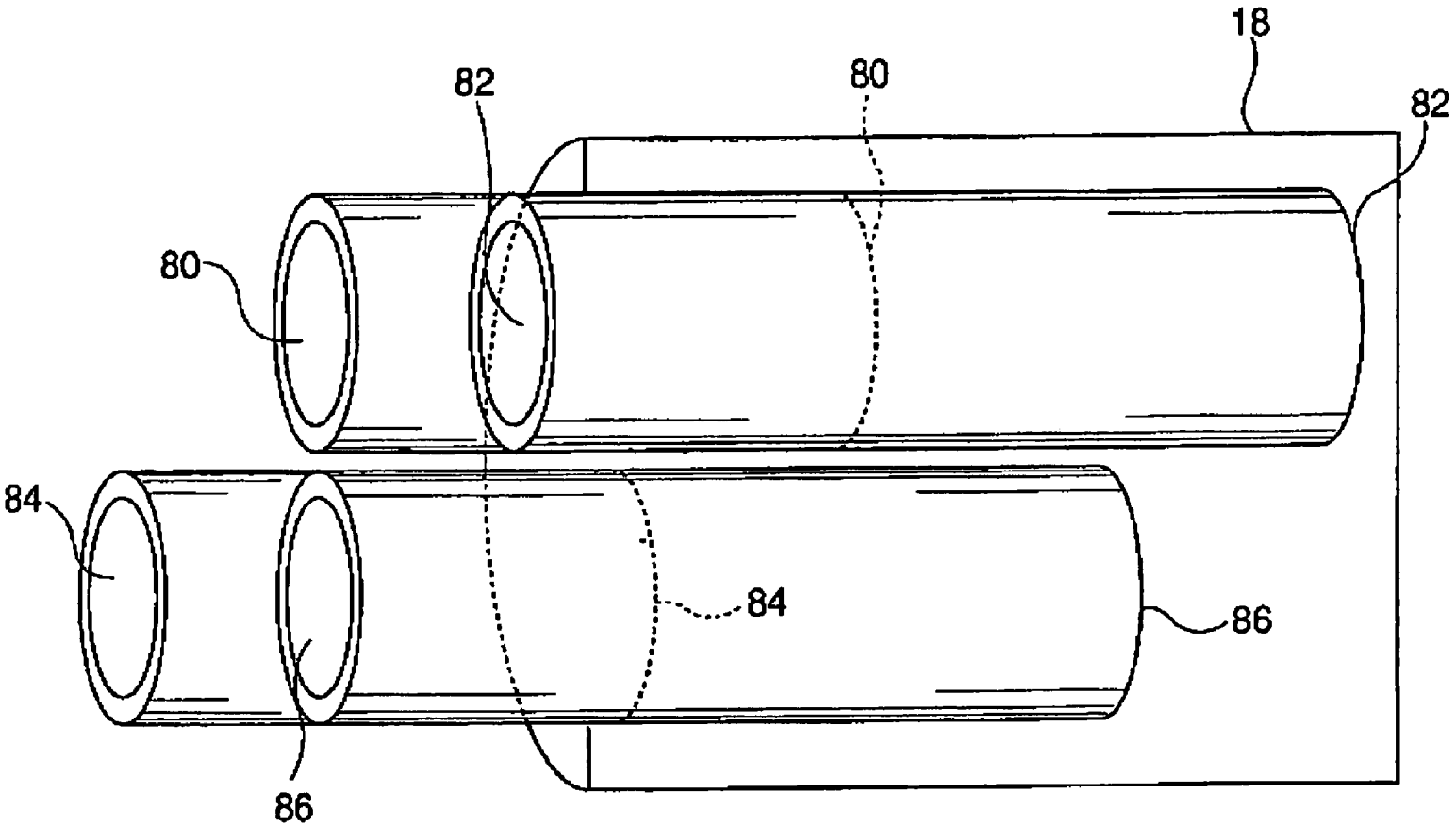
FIG. 3 Prior Art
FIG. 3 schematically shows the side view of the collector of FIG. 2.

In accordance with my U.S. Pat. No. 5,199,258 invention, and as is schematically illustrated in FIG. 3, the individual collector pipes 80, 82, 84 and 86 are selected of a predetermined length so as to substantially equalize the total length of each header pipe and fitted collector pipe, measured from the engine heads to the output of the collector 18. Thus, for the case where the length of the header pipe 20 is the shortest of the lengths of the header pipes 20, 22, 24 and 26, the collector pipe 82 in connection with which it slides, would have the longest length of the four collector pipes 80, 82, 84 and 86. In corresponding manner, where the length of the header pipe 26 is as shown in FIG. 2 to be of the greatest length of the four header pipes employed, the collector pipe 84 in which it slidably is inserted would be of the shortest length of the four collector pipes. In similar fashion, as the header pipe 24 is, as shown in FIG. 2, of a greater length than the header pipe 22, in FIG. 3, correspondingly, the length of the collector pipe 80 is shown to be shorter than the length of the collector pipe 86. In establishing these relative lengths, such invention carried through the concept that best engine performance and least engine "ping" resulted from having the overall individual lengths of the individual header pipes and their respective collector pipes all be substantially equal.

As is thus far described, it will be understood that the collector 18 can thus slide toward, or away from the engine, as to the left or to the right, correspondingly, in FIG. 3. Testing showed that by sliding the collector 18 forwardly (as to the left in FIG. 3), more engine torque is available, and the time for which exhaust gases take to travel from the engine to the system's exhaust coupling via the collector output is shortened. Testing has similarly showed that by sliding the collector 18 rearwardly (i.e., to the right in FIG. 3), a longer period of time is taken for exhaust gases to travel to couple to the vehicle's exhaust system, providing a higher rpm, in holding the horsepower longer, but a slightly-less torque. Analysis showed that by varying the distance that the collector 18 was moved forwardly or rearwardly, an adjustable control of the torque and of the horsepower could be attained, in order to meet vehicle objectives of the user.

Figure 4:
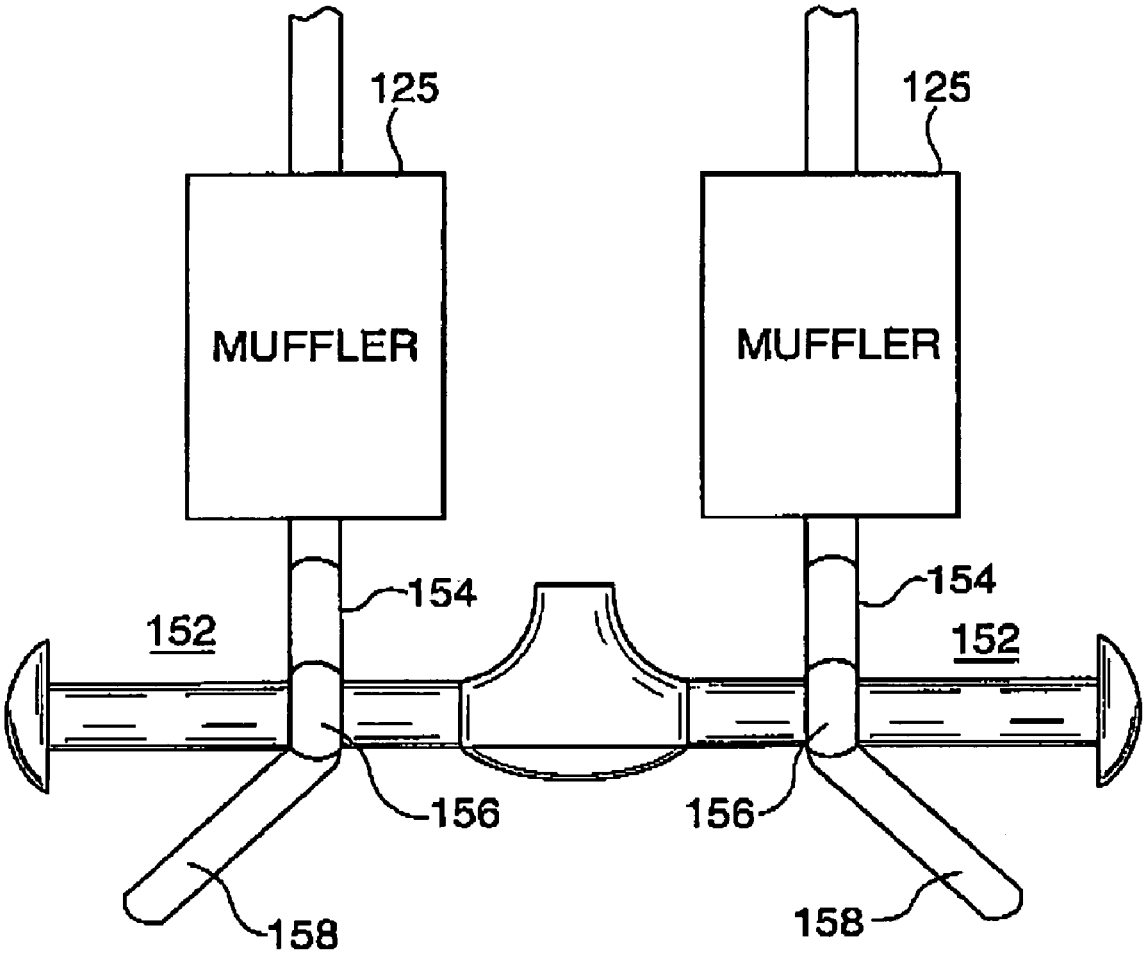
FIG. 4 Prior Art
FIG. 4 pictorially illustrates the exhaust system of an automotive vehicle in accordance with the teachings of the invention set out in my U.S. Pat. No. 5,144,799.
Figure 5:
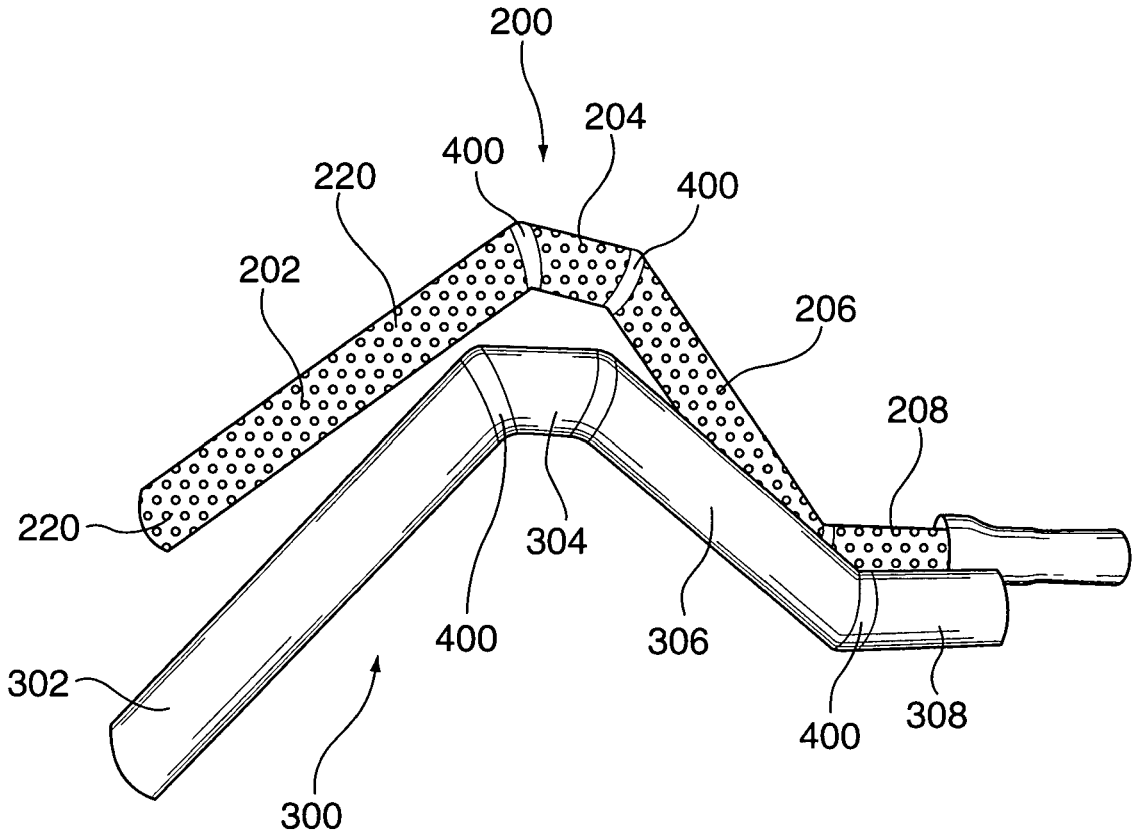
FIGS. 5–8 are illustrations helpful in understanding the overlying surround pipe segment constructions of the present invention.
Figure 6:
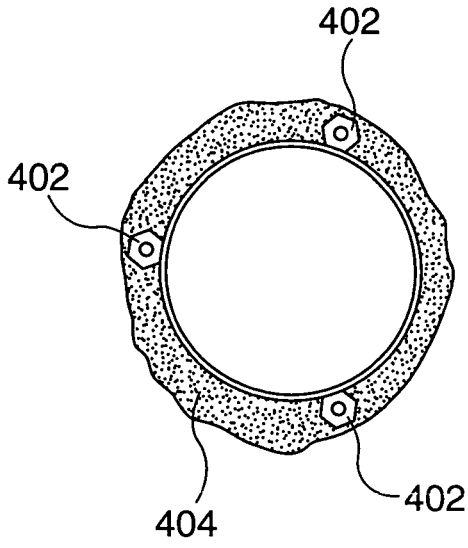

As generally set out in my other U.S. Pat. No. 5,144,799, the exhaust system from the motor vehicle is most oftentimes bent in various odd-shapes so as to clear its rear housing, its power steering systems, and its other control installations to meet with the tailpipe in channeling the exhaust flow away. As with the teachings of my U.S. Pat. No. 5,199,258, my U.S. Pat. No. 5,144,799 taught that advantages could follow by cutting the exhaust pipe from the muffler to the tailpipe into similar individual sections to clear obstructions, rather than being bent into position. By providing a "straight" exhaust flow in this manner through shortening the path the exhaust gas takes to the outside atmosphere, a degree of calibration was available to likewise control the torque, horsepower, manifold vacuum and engine temperatures associated with the system in use. As therein set forth, and as shown in FIG. 4 herein, the odd-shaped, bent piping exhaust assembly coming off the muffler 125 is replaced by a series of individually connected short pipe segments 154, 156, 158. interconnected to avoid the rear housing and its components, and to exhaust the gases from the motor vehicle (either as shown), or by a separate tailpipe (not shown). Although specifically shown as comprising three separate pipe segments, the pipe exhaust assembly 152 could consist of fewer or less separate pipe segments, as the circumstances warrant—the understanding being, however, that individually cut pipes provide superior performance than to utilize an odd-bent shape, and represents an improvement not only in the ease of manufacture, but in enhanced operation of performance. Specifically, and as such patent indicated, experimentation showed that the use of individually cut pipe segments decreased the path which the exhaust gases flowed in order to leave the automotive vehicle, lessening the chances for the engine "loading-up" and "chugging" or choking in its performance.

As will be readily understood by those skilled in the art, to facilitate the interconnections of the pipe segments 154, 156, 158—as well as to join them with the output of the muffler 125 which couples to the output end of the collector 18—the pipe segments 154, 156 and 158 are both rotated and cut at various angles, and then welded together to clear the rear housing, and its components. What the length for each of the pipe segments 154, 156 and 158 might be, and upon what angle the cutting depends for joining the individual segments together, all depend upon the rear housing configuration. In constructing the arrangement, it will be understood that once one pipe segment is cut, it is rotated until the proper angle is obtained where it is to be joined with the next pipe segment, and with all the segments then being welded together. Where the muffler 125 is located along the line, and whether any tailpipe is to be employed or not (as my U.S. Pat. No. 5,144,799 points out) will obviously depend upon the specific application for the exhaust system described. In this arrangement, the pipe segments 154, 156 and 158 could be of a substantially 3" outer diameter.

While testing showed that an internal combustion automotive engine system designed with these individual pipe segments being cut at these individual lengths, angled together in their individual amounts and then welded together, perform quite adequately, one limitation continued to be the "back-pressure" created by the muffler. This, however, can be obviated in accordance with the teachings of the present invention, in which the muffler is entirely eliminated to begin with—, and by redesigning the flow directing pipe segments to themselves serve as the "muffler" for the exhaust. As will be seen from the description which follows, this is accomplished, generally, by the providing of a series of apertures along the lengths of the individual pipe segments of the header pipes and/or providing apertures along the lengths of the rear-housing pipe segments (to be coupled directly to the output of the collector instead of to any included muffler)—and, then by enclosing and containing the individually apertured pipe segments within a surrounding shield or pipe similarly cut and angled so as to overlie the individual segments in corresponding alignment to clear the various undercarriage components of the vehicle. "Pipe segments within pipe segments" thus result, with optimum performance in the nature of improved torque, improved horsepower, enhanced fuel economy, and reduced "back-pressures" following when the apertures are provided both in the exhaust pipe segments and in each of the header pipe segments. Enhanced performance in these areas, although slightly less than optimum, has been also found to result where the apertures are provided either in just the exhaust pipe segments, or just in each of the header pipe segments. With the pipe segments previously dimensioned, the surrounding pipe segments of the invention for that of the header pipe segments could be of a 2½" inner diameter while the surrounding exhaust pipe segments could be of a 4" inner diameter. Appropriate "spacers" could be provided on the internal pipe segments so as to center them within the surrounding shield segments in providing the needed "muffling", which could be increased still further by a steel wool wrapping around the apertures within the space between the overlying segments in providing a very highly effective and efficient muffled environment.

Figure 7:
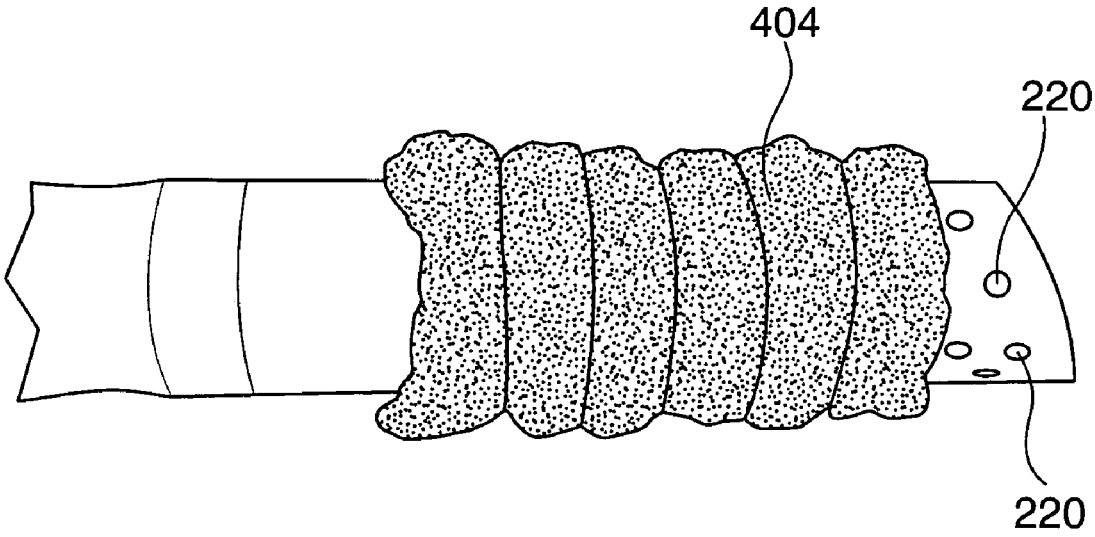
Figure 8:
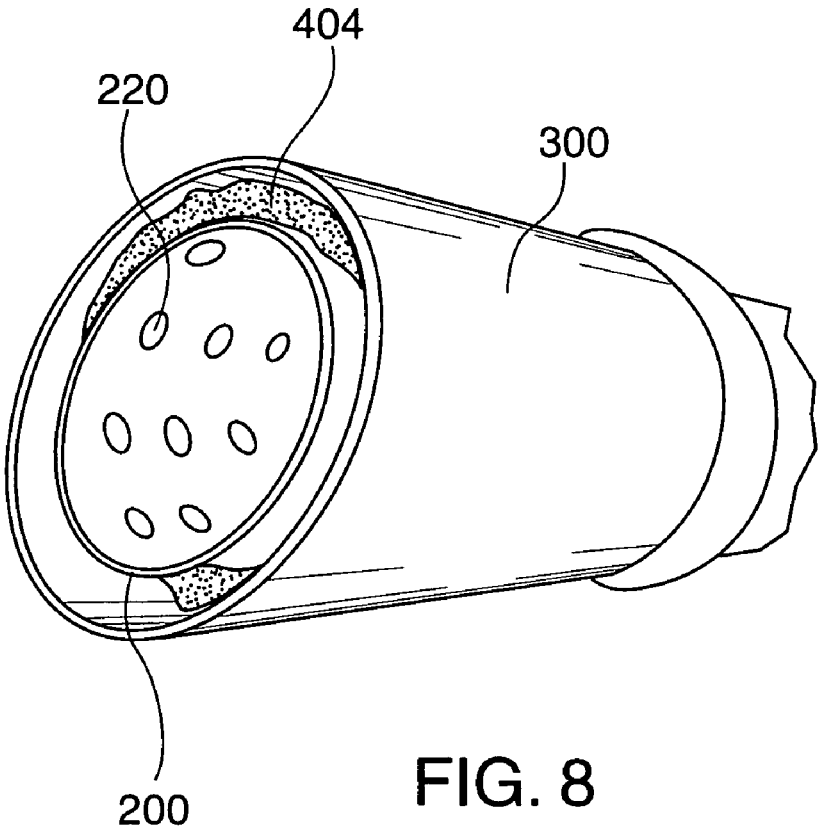

Thus, referring to FIGS. 5–8, the internal pipe segments of the exhaust pipe and/or of the header pipe are generally shown as 202, 204, 206 and 208 of the pipe 200—apertured in a preferred embodiment along their entire lateral lengths, as at 220. In like manner, the surrounding pipe of like cut and angled segments 302, 304, 306 and 308 is shown at 300 with the individual segments of both pipes 200 and 300 being cut, angled and secured together as generally shown at 400. Spacers shown at 402 in FIG. 6 at 120° spaced intervals about the circumference of the pipe 200 serve to center the pipe 200 within the surrounding pipe 300, while a steel wool-type wrapping 404 is wound around the various apertures of the inside pipe 200 as shown in FIG. 7. The end view of FIG. 8 illustrates the surrounding of the pipe 200 within the pipe 300, centered and with the steel wool-type wrapping in place.

In accordance with the invention, this "pipe-within-a-pipe" combination could be utilized either for just the exhaust pipe, of the automotive vehicle, for just the header pipe connections from the engine to the input end of the collector, or as both—which provides the optimum performance. Utilizing the teachings for only the exhaust pipe construction, or for only the header pipe constructions, reduces performance somewhat, but still enhanced with respect to that which characterizes conventional muffler use. Testing has shown that to be the same situation with the wrapping of the individual surrounded apertures—namely, leaving the apertures uncovered provides a performance characteristic greater than with the conventional muffler, and even more with the individual apertures being covered. In a preferred construction of the invention, the inner diameter of the surrounding pipe segments when enclosing the header pipe segments may be of the order of 2½" when the outer diameter of the header pipe segments is of substantially 2". In like manner, an inner diameter for the surrounding exhaust pipe segments might be of some 4" with an outer diameter of its contained pipe segments being 3".

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

The invention claimed is:

1. In an exhaust system of an automotive vehicle, the combination comprising:

a collector pipe having multiple inputs and a single output;

a plurality of header pipes individually coupled from the head of an internal combustion engine to one of said multiple inputs of said collector pipe;

an exhaust pipe directly coupled to said output of said collector pipe;

with each of said header pipes and said exhaust pipe being composed of a plurality of pipe segments of preselected length, cut at their ends at preselected angles, for joining together in orientation to traverse component parts of the rear housing, steering system and control installations of the automotive vehicle;

a further pipe cut into segments of preselected lengths and at preselected angles for surrounding and containing at least one of said exhaust pipe and the pipe segments thereof, and each of said header pipes and the pipe segments thereof;

and with the surrounded pipe segments having a plurality of apertures spaced apart from one another substantially along their entire respective lengths;

the combination supplanting any need for a muffler in the automotive vehicle exhaust system.

2. The combination of claim 1 wherein said further pipe is centered about each of said surrounded plurality of exhaust pipe segments and surrounded plurality of header pipe segments.

3. The combination of claim 2 wherein said exhaust pipe segments are of a substantially 3" outer diameter and said further pipe is of a substantially 4" inner diameter.

4. The combination of claim 2 wherein said header pipe segments are of a substantially 2" outer diameter and said further pipe is of a substantially 2½" inner diameter.

5. The combination of claim 2, further including a steel wool wrapping around individual ones of said surrounded exhaust pipe segments and surrounded header pipe segments, about the individual apertures thereof.

6. The combination of claim 2, further including a steel wool wrapping around each of said surrounded exhaust pipe segments and surrounded header pipe segments, about the individual apertures thereof.

7. The combination of claim 2 wherein said plurality of apertures are spaced apart from one another both horizontally and vertically along their respective lengths.

* * * * *